US005519413A

United States Patent [19]

Thomas et al.

[11] Patent Number: 5,519,413

[45] Date of Patent: May 21, 1996

[54] METHOD AND APPARATUS FOR CONCURRENTLY SCANNING AND FILLING A MEMORY

[75] Inventors: Larry J. Thomas; Douglas E. Thorpe, both of Albuquerque, N.M.

[73] Assignee: Honeywell Inc., Minneapolis, Minn.

[21] Appl. No.: 155,065

[22] Filed: Nov. 19, 1993

[51] Int. Cl.[6] ..... G09G 5/00

[52] U.S. Cl. ..... 345/185; 345/190; 345/200

[58] Field of Search ..... 345/201, 190, 345/200, 193, 185

[56] References Cited

U.S. PATENT DOCUMENTS

| | | | |
|---|---|---|---|
| 4,094,000 | 6/1978 | Brudevold | 364/900 |
| 4,228,526 | 10/1980 | Lee | 365/183 |
| 4,404,554 | 9/1983 | Tweedy, Jr. et al. | 340/750 |
| 4,493,060 | 1/1985 | Varshney | 365/238 |
| 4,562,435 | 12/1985 | McDonough et al. | 340/798 |
| 4,574,277 | 3/1986 | Krause et al. | 340/703 |
| 4,631,531 | 12/1986 | Maeda | 340/701 |
| 4,648,077 | 3/1987 | Pinkham et al. | 365/240 |
| 4,673,930 | 6/1987 | Bujalski et al. | 340/703 |
| 4,689,741 | 8/1987 | Redwine et al. | 364/200 |
| 4,720,819 | 1/1988 | Pinkham et al. | 365/219 |
| 4,744,046 | 5/1988 | Foster | 364/900 |
| 4,799,198 | 1/1989 | Ogawa | 365/221 |
| 4,847,608 | 7/1989 | Bouron | 340/747 |
| 4,887,228 | 12/1989 | Robert | 364/521 |
| 4,941,127 | 7/1990 | Hashimoto | 365/189.01 |

*Primary Examiner*—Ulysses Weldon
*Assistant Examiner*—Matthew Luu
*Attorney, Agent, or Firm*—John P. Sumner; Kenneth J. Johnson

[57] ABSTRACT

A method and apparatus for concurrently scanning and filling a memory comprised of at least a first and a second memory partition for use in a video display of the ping-pong type is provided herein. A method according to the present invention includes scanning the first memory partition and concurrently filling the second memory partition, such that a fill pattern is stored in every memory cell in the second memory partition during a time period in which a portion of memory cells in the first memory partition are scanned. A method in accordance with the invention can be incorporated into a video display system with minimal modifications to provide a fast fill or clear of a memory partition.

28 Claims, 6 Drawing Sheets

START
IS F(X,Y) OVERLAY ?
100
YES
101
OUTPUT F(X,Y)
NO
IS F(X−1,Y) OVERLAY ?
102
YES
103
OUTPUT F(X−1,Y)
NO
IS F(X,Y−1) OVERLAY ?
104
YES
105
OUTPUT F(X,Y−1)
NO
IS F(X−1,Y−1) OVERLAY ?
106
YES
107
OUTPUT F(X−1,Y−1)
NO
108
OUTPUT F(X,Y)
RETURN 91
50ms
ACCESSPAGE 1
ACCESSPAGE 2

110
16.7ms
ODD
EVEN
ODD
EVEN
ODD
EVEN
ODD

90
AUTO SET
AUTO SET
AUTO SET

73
WR*

78
WR*

72
RD*

77
RD*

71
CE*

76
CE*

METHOD AND APPARATUS FOR CONCURRENTLY SCANNING AND FILLING A MEMORY

The Government has rights in this invention pursuant to Contract No. F33600-88-G-5107, awarded by the Department of the Air Force.

FIELD OF THE INVENTION

The present invention is directed to a method and apparatus for filling or clearing a video memory device, and more particularly, to a method and apparatus for filling or clearing a video memory while concurrently scanning another video memory in a video display system of the ping-pong type.

BACKGROUND OF THE INVENTION

Various methods of filling or clearing a block, or partition, of a memory are well-known in the art. For simplicity's sake, discussion hereafter will generally be limited to filling methods, as clearing methods are simply filling methods where the information stored is a null, or clear, value. The difference between storing a fill value containing a fill pattern, or a clear value containing a null pattern, is insignificant. One skilled in the art will appreciate that any disclosure relating to filling methods is equally applicable to clearing methods as well.

By a memory block or partition, we mean a logical array of memory cells, each of which is logically addressable by a unique address, the addresses typically, but not necessarily, being numerically consecutive. A memory block or partition, being organized in a logical array, is merely a virtual construct independent of the components or methods used in implementing the physical storage of the memory cells in the logical array, such as the number, sizes, types or organization of memory devices, the additional circuit components required, or the method of translation of logical addresses into physical storage addresses. By a memory cell, we mean a storage location having a physical address on a memory device, and further being logically addressable in the memory partition. A memory cell can be any number of bits in size, or width, to enable storage of a value of any numerical magnitude. By a memory, we mean the storage space for a video display system organized into a logical array of memory cells and partitioned into one or more memory partitions.

Filling and clearing methods are particularly useful in video display systems in which a memory partition is a page of video information, and where multiple partitions, or pages, may be used, or where video information is continuously updated or refreshed. Memory cells in the memory partition typically correspond to individual pixels in the display. Depending upon the number of colors or shades available for a pixel, the memory cells can range in size from 1 bit to 8 bits or more. The size of a memory partition is therefore a function of the resolution (the number of pixels in the display) and the number of available colors or shades.

Video display systems typically have one or more memory partitions, with each partition containing a complete screen of video information to be displayed. Dedicated hardware typically scans through the video information stored in the partitions continuously, to provide a video signal for display on a video display monitor. As is typical with most video display systems, a screen of information is displayed on a monitor first at the upper left corner of the display, which will typically correspond to the first memory cell in a memory partition. The memory partition is typically organized into contiguous rows of memory cells, so that the video information is read from memory cells logically addressed consecutively in the memory partition, and displayed from the left to the right in a row, then downward through each subsequent row, until the last memory cell in the memory partition has been read, and the pixel at the lower right corner of the display has been displayed. The scanning of one complete partition of memory constitutes a frame, or display update cycle, and a video display system typically displays frames at a rate of 20–60 Hertz (frames/second). The scanning of one memory cell constitutes a pixel scan cycle.

One variation on this scanning technique, interlacing, is commonly used to reduce the flicker on a video display monitor. In this technique, update frames are broken up into two or more fields which are displayed during a frame period, where each field is typically a portion of the video information in a partition of memory. Generally, a video display system has been organized to provide two fields per update frame, and to alternate between displaying the odd and even rows in a memory partition, as depicted generally in FIG. 1. Interlacing such as this provides a more pleasant display that has less flicker than non-interlaced systems. As a further improvement, fields may be started in the middle of a row, for systems in which an odd number of rows are used, such the RS-170 standard of 525 rows, where 262.5 rows are scanned per field.

Another type of interlacing technique may be used to provide additional memory access time by repeating the first field in the update frame after the second field, then starting the next update frame on the opposite field as the first field of the prior update frame, as shown in FIG. 2. In such a technique, the first update frame would consist of displaying an odd field, an even field, and an odd field, and the second update frame would consist of displaying an even field, an odd field, and an even field, etc.

A further enhancement for a display scanning method beyond interlacing is known as interlaced raster enhancement. In a system of this type, both a row and a previous row are provided to the system, so that the memory cell in the row above the current memory cell is also scanned during the pixel scan cycle for the current memory cell (i.e. (x,y) and (x,y−1)). Further, the two memory cells scanned in the previous cycle (i.e. (x−1,y) and (x−1,y−1) are stored for use with the scanning of the current memory cell. Thus, a total of four memory cells are available for each pixel scan cycle.

The interlaced raster enhancement algorithm first checks the current memory cell (x,y) to see if the memory cell contains the background value (designated "map") or overlay video information (designated "overlay"). If the memory cell contains overlay, then the contents of that memory cell are output as the pixel corresponding to the current memory cell. If the memory cell is map however, the system then successively checks the (x−1,y), (x,y−1), and (x−1,y−1) memory cells, in order, and outputs the first memory cell containing overlay information. If none of the memory cells contain overlay information, then the map information is output.

The interlaced raster enhancement improvement significantly reduces flicker in displays. In general, the current memory cell is scanned during the high portion of a pixel clock (operating at the pixel scan cycle rate), and the second memory cell in the previous row is scanned during the low portion of the pixel clock. In addition, the comparisons are not time consuming and do not require much in the way of additional hardware, so the enhancement does not decrease the speed or significantly increase the space for the system.

Another type of enhancement for video display systems is known as the ping-pong type of video display system. Such a system uses two or more memory partitions to store video information, continuously alternating between displaying the information in each partition. In a system of this type having two memory partitions, the video information in one partition is scanned and displayed while new video information is written to in the other partition (a "display update"). The partition which is currently being displayed is designated a selected memory partition, and the partition which is currently being written to, or updated, is designated a non-selected memory partition.

In a single partition video display, the system must allocate memory access between writing information to, and scanning information from, a single memory partition. In addition, care must be taken to prevent incomplete information transfers to the partition, as undesirable displays, or garbage, may result. Typically, this problem has been remedied by either blanking the screen during display updates, or by limiting memory access to the partition to the vertical retrace period, which is the period required for the electron beam of a video display to travel from the bottom of the display at the end of one field to the top of the display at the beginning of the next. The first alternative, blanking, produces a visually disruptive display which is unsuitable for many real-time applications having constant updates. The second alternative, limiting memory access, limits the amount of information that may be written to a memory partition.

The ping-pong type of system, on the other hand, allows information to be written to one memory partition while the other partition is being scanned and displayed. Information may be written without contending for memory access time, so therefore more information may be written to a memory partition. Additionally, no garbage or partial memory transfers interfere with the display. Finally, the display does not need to be blanked, so that displays requiring continuous updates will be smooth and flicker-free.

In many prior video display systems, dedicated hardware, such as a video generator, is responsible for continuously scanning information from the memory partitions, generating color data from the scanned information, and producing the various video signals necessary for displaying the information on a video display monitor. Other dedicated hardware, such as a graphics generator, is responsible for updating or writing new information to the partitions. In addition, a graphics generator or the like may also perform filling and/or clearing routines or methods. Especially in ping-pong systems, a fill or clear is performed at the beginning of each display update frame, so that new information can be written to the partition. The routine must execute in a short enough period of time to enable the graphics generator or other hardware to have sufficient time to write new information to the partition.

Typically, filling and clearing methods used in video display systems, in order to completely fill or clear a memory partition, must write, or store, information into each memory cell in the partition. The most basic of the filling methods is to consecutively write to each memory cell in the memory partition. However, each write operation on a memory cell takes a fixed amount of time. The consecutive write methods may be sufficient for small memory partitions (for low resolution displays), or for applications which are not speed-sensitive (long display rates); however, as the resolution and available colors of video displays have increased, memory and speed requirements have also increased, and a need has developed for improved routines for quickly filling a larger partition of memory.

One improvement on the basic consecutive write method of filling a memory partition is to allocate the physical storage of a memory partition between a number of memory devices, so that a write operation can be performed concurrently for a memory cell in each memory device. The time required for a fill would then be decreased by a factor of the number of memory devices which are accessed simultaneously (e.g. a fill of a memory partition allocated onto four memory devices would take ¼ the time required with one memory device).

The advantages of this improved method ironically stem from limitations on the storage capacity of memory devices. Larger memory partitions must necessarily be allocated among a number of memory devices, due to the limited storage capacity of the memory devices. Therefore, many memory devices may be required for applications having large memory requirements.

For example, in a system having a display of 512 columns ×512 rows, or 256K (1K=1024) pixels, each pixel being one of 256 colors or shades, 256K memory cells, each being 8-bits wide, are required in each memory partition. The state of the technology at one point required eight 32K×8 memory devices (the first number being the number of memory cells, the second the number of bits per cell), such as an IDT 71256 Static RAM manufactured by Integrated Device Technology. The ability to simultaneously write to eight devices provided for a fast fill time which was one-eighth of the time which would be required were each memory cell consecutively written. Assuming, for example, a graphics generator having a 125 nanosecond write time each memory cell on a memory device, this would result in a fill time ($t_{fill}$) of:

$$t_{fill}=32K\times125ns=4.1ms$$

In a typical video display system having, for example, a 20 Hz display update rate, where the frame period is 50 ms, ample time is left over in the frame after a fill to write the new information to the memory partition.

The state of the technology in memory device fabrication continues to advance, and memory devices having larger storage capacities have been developed. The advances have allowed larger memory partitions to be allocated among fewer memory devices, which is particularly useful for applications having size limitations, power limitations, etc.

The state of technology now allows for the display of 512×512 eight-bit pixels (256K eight-bit memory cells) of the previous example to be implemented in two 256K×4 memory devices, such as a 41028 Static RAM chip manufactured by Paradigm Technology, Inc. However, as each memory partition is now only allocated among two devices, the fill time using the same graphics generator becomes:

$$t_{fill}=256K\times125ns=32.8ms$$

In a typical video display system having the same 20 Hz display update rate as before, over half of the frame period is taken up by the fill method, leaving little time to write the new information to the memory partition.

Therefore, a need exists in the art for a filling or clearing method which is capable of quickly filling or clearing a large memory partition, especially those in which the partition is allocated among only a few physical memory devices. In addition, in applications having size or power limitations, a further need exists for a filling or clearing method which can be implemented using minimal hardware above and beyond the hardware used in size-limited video display systems.

SUMMARY OF THE INVENTION

The present invention overcomes many of the above-mentioned problems in the prior art by providing a concurrent scan and fill method for use in a video display system of the ping-pong type having a memory including at least a first and a second memory partition. The present invention provides for scanning the first memory partition and concurrently filling the second memory partition, such that a fill pattern is stored in every memory cell in the second memory partition during a time period in which a portion of memory cells in the first memory partition are scanned.

BRIEF DESCRIPTION OF THE DRAWINGS

Referring to the drawings, wherein like numerals represent like parts throughout the several views.

DETAILED DESCRIPTION OF THE PREFERRED EMBODIMENT

A preferred apparatus and method for concurrently filling and scanning a memory in a video display system of the ping-pong type consistent with the present invention is provided herein. They are disclosed herein in order to illustrate our current understanding of the invention. However, since many variations of the invention can be made without departing from the spirit and scope of the invention, the invention resides wholly in the claims hereafter appended.

An apparatus consistent with the present invention may include a memory having at least two memory partitions, and a scanning means for scanning one memory partition and concurrently filling the other memory partition, such that the fill pattern is stored in every memory cell in the other partition during a time period in which a portion of memory cells in the one partition are scanned. In the context of the present invention, concurrently means that as a memory cell is scanned in one partition, a fill pattern may be stored in at least one memory cell in the other partition. It further means that at least two partitions may be enabled and acted upon during each memory cell scan.

Figure 1:
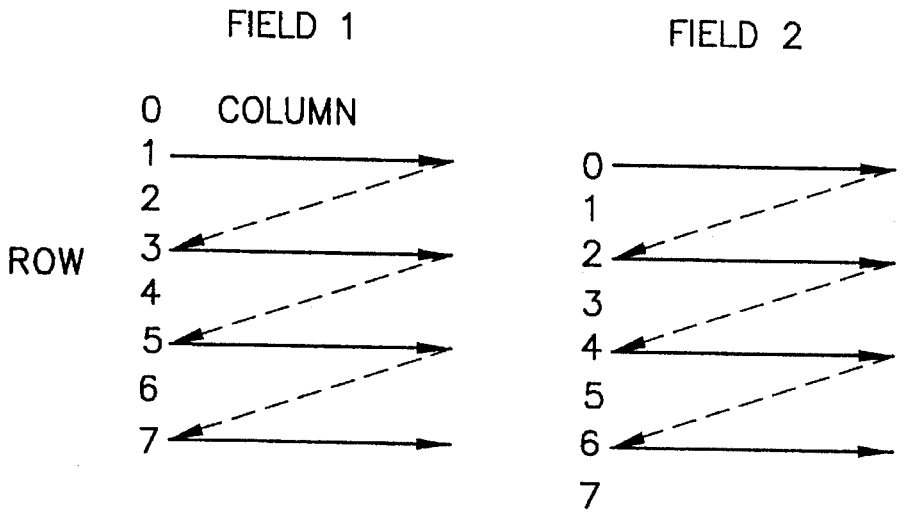
Fig. 1 (PRIOR ART)
FIG. 1 is a schematically-illustrated diagram of a prior interlacing method.
Figure 2:
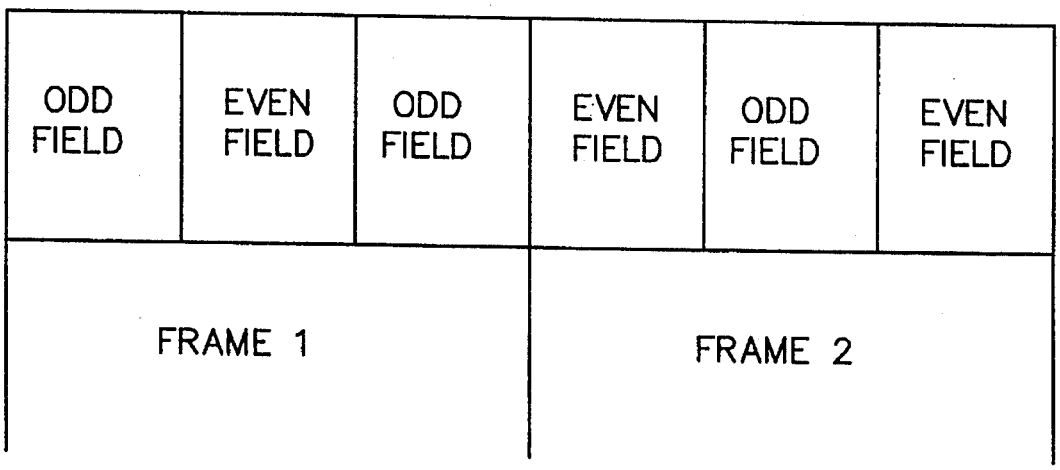
Fig. 2 (PRIOR ART)
FIG. 2 is a general timing diagram for a three field per update frame video display system providing additional memory access time in an update frame.
Figure 3:
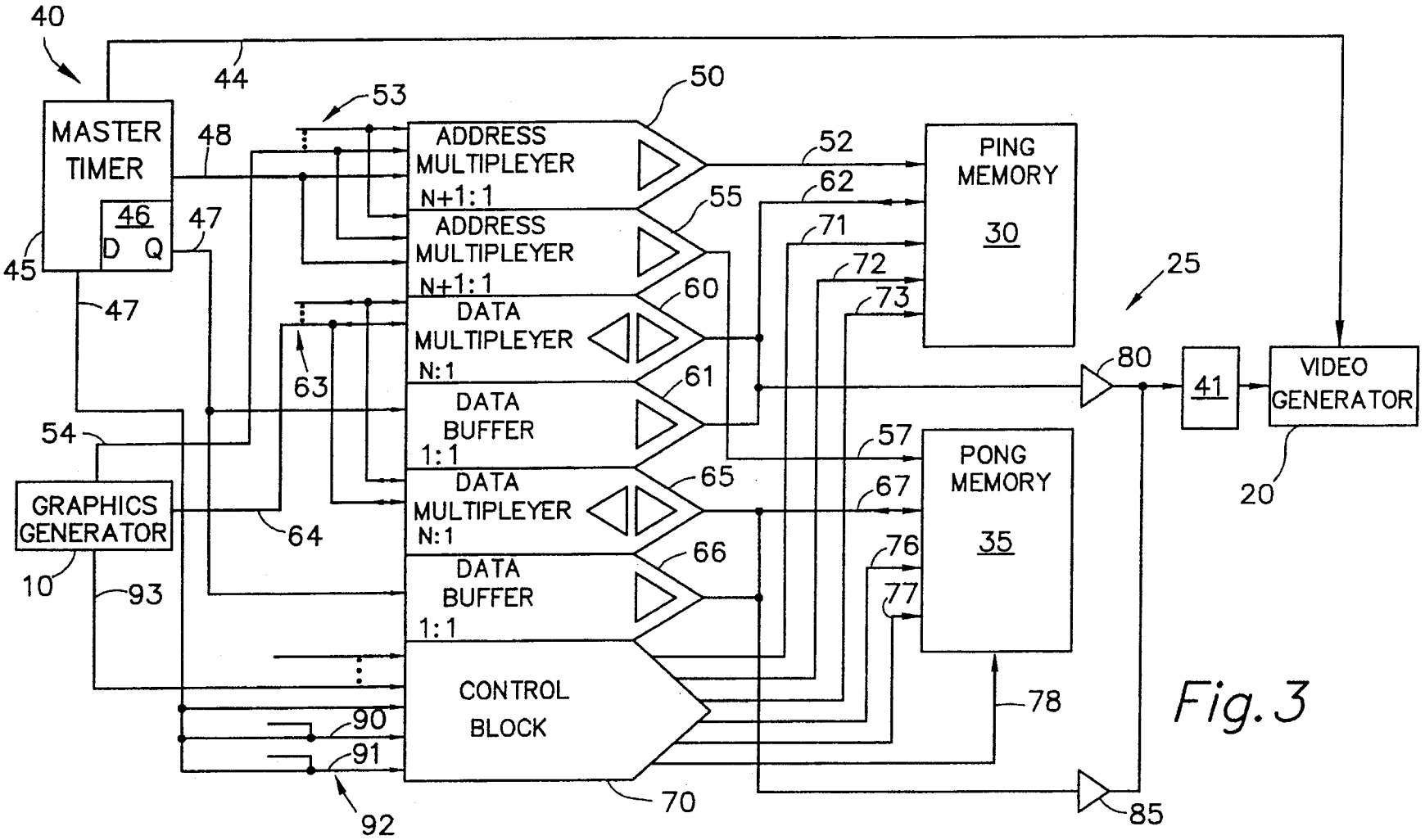
FIG. 3 is a block diagram of a preferred hardware configuration for a video display system.

FIG. 3 is a block diagram of a preferred hardware configuration of a video display system for practicing various features of the invention. The video display system includes graphics generator 10, video generator 20, memory 25, and scanning means 40. The memory 25, in a typical ping-pong type video display system, includes two memory partitions, "ping" memory 30 and "pong" memory 35. Each partition contains video information for one page of video information, and the video display system alternates in each update frame between displaying the information in each partition. Each partition is organized into a plurality of memory cells, each of which is capable of holding a data value of a fixed width in bits. Memory cells are logically addressable in a partition by an address which can be broken up into a column and a row component, corresponding to the number of columns and rows present in a page of video information. It is important to note, however, that a partition may also include additional storage beyond that required to store a page of video information.

Each memory partition 30 and 35 can be comprised of any number of physical storage devices. In the preferred embodiment, physical storage of each memory partition 30 and 35 is handled by two 256K×4 bit static RAM devices (four in all), such as 41028 static RAMs manufactured by Paradigm Technology, Inc. Each memory partition, with this physical storage capacity, is configured into 512 columns ×512 rows of 8-bit memory cells. A video display for use with these partitions would be capable of having up to 512×512 pixels of 256 colors or shades.

Each memory partition includes a number of inputs and outputs for communication and control by the rest of the system. For memory partition 30, memory cells are selected through address lines 52, and data is transferred between the memory partition and the rest of the system through data lines 62. For this system, where there are 512×512 (256K) 8-bit memory cells, address lines 52 will be 18 bits wide, and data lines 62 will be 8 bits wide. For control, memory partition 30 has a chip enable line (CE) 71, a read enable line (RD) 72, and a write enable line (WR) 73, each of which is typically active-low. For memory partition 35, the corresponding address lines are numbered 57, the data lines are numbered 67, and the chip, read, and write enable lines are numbered 76, 77 and 78, respectively.

Graphics generator 10 can be any of a number of commercially available or application-specific IC (ASIC) devices. Its primary function is to store video information in the memory. In many prior art video display systems, another function of the graphics generator is to fill or clear the memory before storing new information. However, this function herein is off-loaded from the graphics generator, which frees it up for other processing during a fill or clear.

Video generator 20 can also be any of a number of commercially available or ASIC devices. It is connected to data lines 62 and 67 through buffers 80 and 85, respectively, whose outputs are selectively enabled by scanning means 40. It is also provided with a number of signals, such as sync and blanking signals, from scanning means 40. Its primary function is to process information scanned from the memory 25 by scanning means 40, and to generate video signals from this processed information for display on a video monitor. Information received from the memory can be fed through a color look-up table, in order to generate separate red, green and blue video signals from the 8-bit data values received. In addition, video generator 20 processes sync and blanking signals from the scanning means 40, and the information received from the memory, and produces analog signals generated by digital to analog conversion circuitry. The various signals provided by video generator 20 ultimately drive a video monitor or display to be viewed by an end user.

Scanning means 40 is used for continuously scanning memory 25 and providing the scanned data values to the video generator 20 for conversion and display on a video monitor. The primary control component for scanning means 40 is master timer 45, which is connected to ping memory and pong memory 35 through a number of multiplexers and buffers, numbered 50 , 55, 60, 61, 65 and 66. In order to save space and reduce the number of components, master timer 45 is an ASIC, such as a field-programmable gate array (FPGA) like the Actel 1020. Included within master timer 45 is register 46, which holds a fill pattern which is to be stored in memory 25 during a fill or clear routine. This register may be set once at the beginning of a fill or clear routine, or may be continuously set throughout the routine to provide a bit-mapped image to be stored as background information. Also included in master timer 45 is means for generating sync and blanking signals, or any other video signals required by the video generator. These signals are provided by master timer 45 to video generator 20 by lines 44.

Master timer 45 is also connected to ping and pong memories 30 and 35 through a control signal block 70. Control signal block 70 provides a number of control signals to memory 25 to control the access and modes of the ping and pong memories 30 and 35. In a video display system, any number of sources may seek access to a video memory. At the most basic level, the sources seeking access are graphics generator 10 and master timer 45; however, description of the preferred embodiment will assume N sources (of which graphics generator 10 is one) in addition to master timer 45.

Block 70 has a number of inputs. Lines 92 are connectable to any of the N sources or any outside processors, to select which of the N sources or the master timer has access to memory 25, and to control the operation of the scanning means 40. As an example, some of these lines may be connected to graphics generator 10, such as lines 93. Also, some of lines 92 are lines 49, 90 and 91, which are connected to master timer 45. Lines 49 would represent any of those master timer signals required to control the arbitration access to memory 25. Some of these control signals are broken out and depicted by the autoset enable line 90 and page selector line 91. Autoset enable line 90 is asserted by master timer 45 to enable the concurrent fill or clear routine for concurrently filling along with the scanning function of scanning means 40. Typically, this function is performed, and the line is asserted, during the first field of each update frame in a video display sequence.

Page selector line 91 is selectively asserted by master timer 45 in order to control which page of memory is currently being scanned and displayed. Whenever this line is in one state, the ping memory 30 is selected and available for scanning and displaying, and the pong memory 35 is non-selected and available for a fill or clear, or storage by any of the N sources. Whenever this line is in the other state, the pong memory 35 becomes selected and scannable, and the ping memory 30 becomes non-selected and writable.

Block 70 has a number of outputs connected to memory 25. Primarily among these are chip enable lines 71 and 76, read enable lines 72 and 77, and write enable lines 73 and 78, for controlling ping and pong memories 30 and 35, respectively. Block 70 also provides control signals to the various address and data multiplexers, in order to control which of the N sources or the master timer has access to the memory 25.

Address multiplexing in scanning means 40 is handled by address multiplexers 50 and 55, which are connected to ping and pong memories 30 and 35 by address lines 52 and 57, respectively. Each multiplexer 50 and 55 has N+1 inputs, corresponding to the N sources and master timer 45. These N+1 inputs are connected by lines 53 to the various sources, which include lines 48 to master timer 45, and lines 54 to graphics generator 10. Selection of of the N+1 sources is controlled by control signals provided by control block 70.

Data multiplexing in scanning means 40 is handled by data multiplexer 60 and data buffer 61, which are connected to ping memory 30 through data lines 62, and data multiplexer 65 and data buffer 66, which are connected to pong memory 35 through data lines 67. Data multiplexers 60 and 65 are each connected to the N sources by lines 63, including lines 64 to graphics generator 10. These multiplexers are two-way devices, allowing for read and write access to memory 25. Source selection is provided by control signals provided by control block 70.

Data buffers 61 and 66 are connected to ping and pong memories 30 and 35 at their outputs. The inputs to these buffers are connected to register 46 in master timer 45 through lines 47. These buffers hold the value for a fill pattern (which is null for a clear operation) which is to be stored in the non-selected memory during a fill or clear. The buffers are one-way, as a fill pattern is written, but never read. Nonetheless, it would be obvious to one skilled in the art that data buffers 61 and 66 could be incorporated in data multiplexers 60 and 65, and are described separately herein primarily for ease of explanation.

While the above-described structure constitutes a preferred embodiment, one skilled in the art will recognize that various modifications in structure are possible without departing from the scope of the invention. For instance, the address multiplexers, data multiplexers, and data buffers could be incorporated into a single FPGA, ASIC, or into any other combination of devices known by one of ordinary skill in the art.

The scanning means 40 of the preferred embodiment also includes an interlaced raster enhancement device 41 for enhancing the video display of the system. In the preferred embodiment, this device is a separate ASIG device. One skilled in the art will appreciate that device 41 need not be separate, and that other embodiments may implement interlaced raster enhancement in various manners known of in the art. For instance, interlaced raster enhancement could be incorporated into the function of master timer 45, or could be performed by any of the N sources writing to the memory (including graphics generator 10).

Non-interlaced raster enhancement type systems will generally scan through a memory partition left to right across the columns in a row, then proceed downward through subsequent rows, where one memory cell is scanned in a pixel scan cycle. In such systems, an (x,y) address is provided corresponding to the current row (x) and column (y) being scanned.

In an interlaced raster enhancement system such as the preferred embodiment, the master timer 45 provides an (x,y−1) address in addition to the (x,y) address of the memory cell at the current column and row being scanned. During a pixel scan cycle, both the memory cells located at (x,y) and (x,y−1) are scanned, typically at each toggle of the pixel clock. In addition, the enhancement device 41 has storage for the data values retrieved in the previous pixel scan cycle, corresponding to the memory cells at (x−1,y) and (x−1,y−1).

Figure 4:
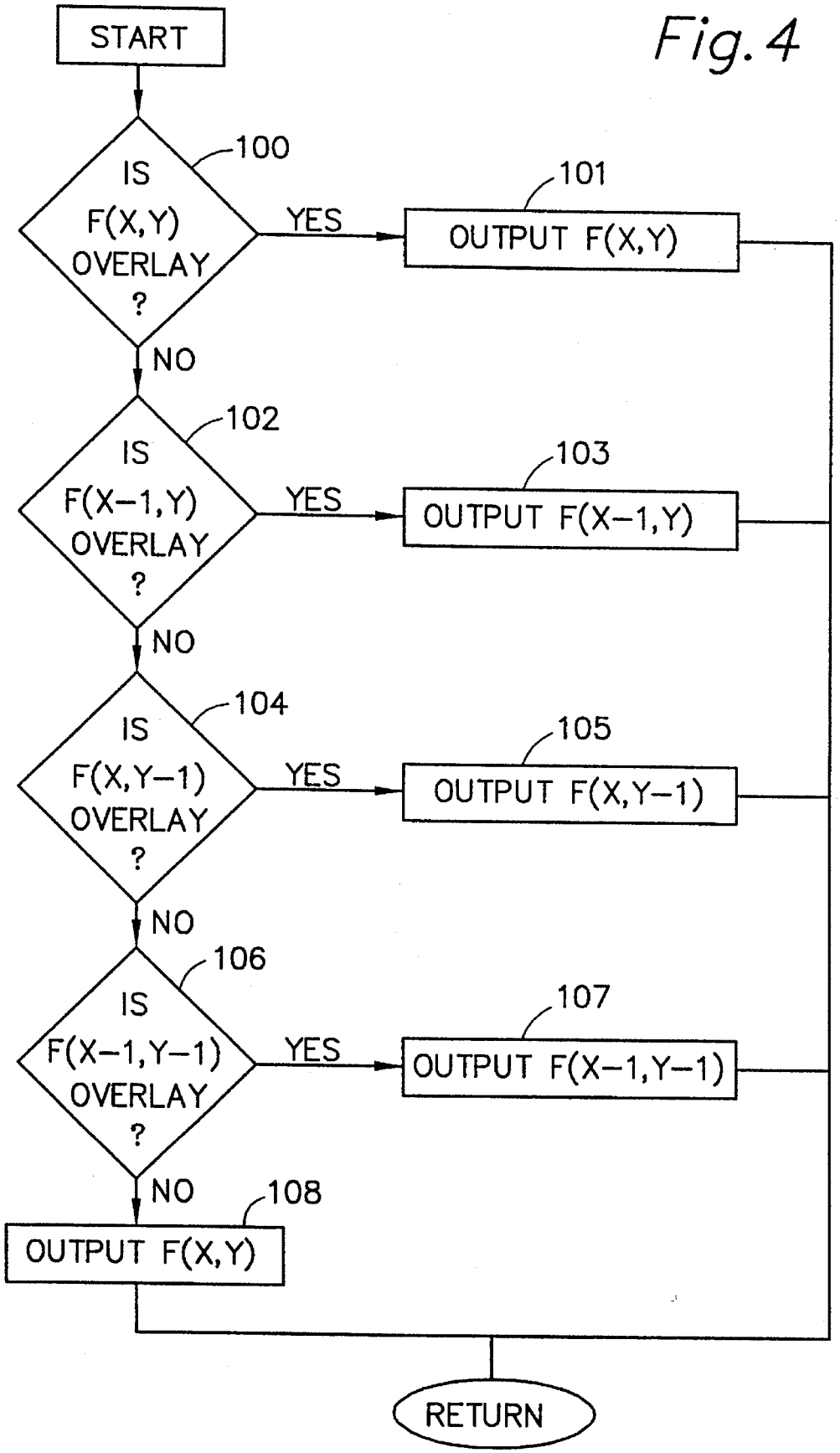
FIG. 4 is a flowchart for an interlaced raster enhancement algorithm.
Figures 5A, 5B, 5C, 5D, 5E, 5F, 5G, 5H, 5I:
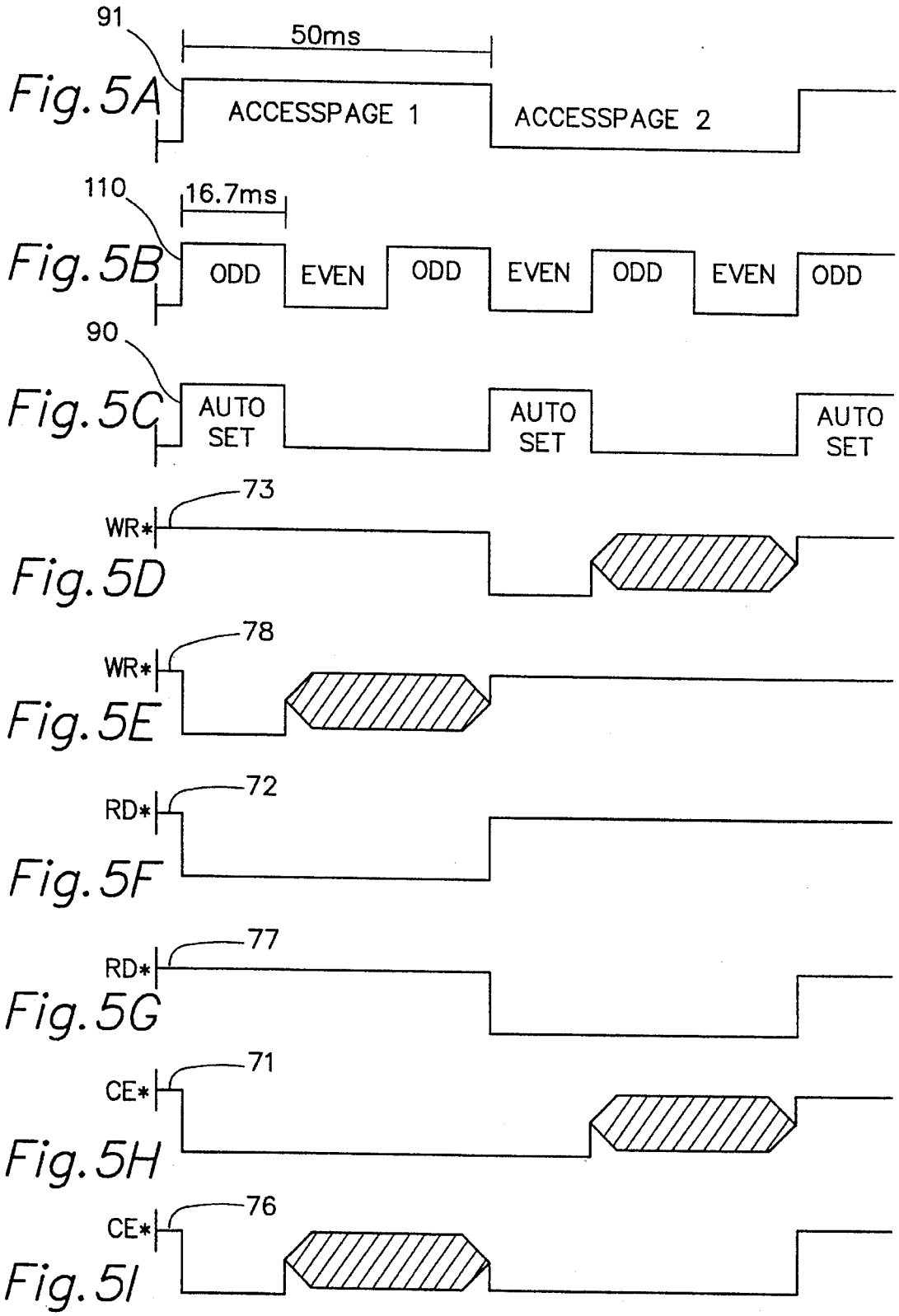
FIG. 5A–I are a timing diagram for a preferred embodiment consistent with the invention.

For each memory cell at the current column and row (x,y), the enhancement device 41 determines what value to display on the video display for that memory cell based upon an interlaced raster enhancement algorithm, such as that shown in FIG. 4. In the algorithm, the enhancement device first checks in block 100 if the data value from the current memory cell at (x,y) is a map or overlay value. By map, we mean background video data, which is typically equivalent to the fill pattern stored in register 46, or a background value supplied from one of the N sources while not including a graphics generator as depicted by block 10. By overlay, we mean video data that has been overlayed by a graphics generator, which is not equivalent to the fill pattern.

If the data value from the memory cell at (x,y) is an overlay value, then that data value is output to the video generator 20 in block 101 as the value to be displayed. If the data value is a map value, then the enhancement device 41 proceeds to check, in order, the data values from the memory cells located at (x−1,y) (block 102), (x,y−1) (block 104), and (x−1,y−1) (block 106), and outputs the first data value which is an overlay, and not a map, value (blocks 103, 105, 107). If none of the data values are overlay values, then a map value is output by default at block 108.

The master timer of the preferred embodiment further includes a filling means consistent with the present invention. In terms of hardware in the preferred embodiment, the inclusion of the filling means in the interlaced raster enhancement system results only in the addition of register 46 to hold a fill pattern, and a write strobe on line 73 or 78 to the non-selected memory partition to enable a fill during the first field of scanning the selected memory partition. No additional hardware devices are required, and no complex processing above and beyond the typical scanning routine are required, because the addresses provided to the selected memory partition for scanning are also provided to the non-selected partition as well. With the fill pattern provided in data buffer 61 or 66 by register 46, and with the non-selected partition enabled by line 73 or 78, filling will occur concurrently with the normal scanning of the selected partition by master timer 45.

Referring to FIG. 5A–I, a simplified timing diagram of the preferred embodiment shown in FIG. 3 is shown. The timing diagram is shown for the system in operation with interlaced raster enhancement operating at a display update rate of 20 Hz (i.e. a 50 ms display update period). In the system shown, two-field interlacing is used, where a frame of information is broken into two fields, an odd and an even field, with the odd field for scanning the odd-numbered rows and the even for scanning the even-numbered rows. In order to provide additional write time to store video information in memory 25 for the possible N sources, including the graphics generator 10, each display update period includes an additional field which is scanned and identical to the first field scanned. By providing the additional field this allows the non-selected memory partition to be cleared or data to be written during the first field, or autoset period, leaving the two remaining fields for writing more data into the non-selected memory partition. Note, that even though there is a 20 Hz update frame rate, the video frame rate continues to remain at 30 Hz, the field rate continues to remain at 60 Hz; thereby still providing a flicker-free display. Therefore, the fill or autoset task time ends up being the field time of 16.7 ms, which is typically faster than the autoset task could be accomplished with a graphics generator.

In the timing diagram of FIG. 5A–I page selector line 91 is shown toggling between high (for scanning ping memory 30) and low (for scanning pong memory 35), with an update frame constituting one half cycle of the page selector cycle. Line 110 is internal to master timer 45, and it is essentially a field clock operating at 60 Hz, which selects an odd or even field scan such that three fields are selected during each display update cycle.

When line 110 is asserted for an odd field scan, every memory cell in odd-numbered rows in the selected memory partition is scanned, and every memory cell in odd-numbered rows in the non-selected memory partition is filled with the fill pattern. In addition, every memory cell in the even-numbered rows of the selected memory partition is also scanned for the purposes of interlaced raster enhancement during the odd field scan, and every memory cell in the even-numbered rows in the non-selected memory partition is filled with the fill pattern, due to the generation of the y−1 address signal by master timer 45. A resultant data value for the memory cells in the odd-numbered rows is provided after the desired data value from the four memory cells is selected by the interlaced raster enhancement means 41 discussed above. Similarly, an analogous operation occurs during the even field scan, where data values are ultimately provided for the memory cells in the even-numbered rows.

The autoset enable line 90 is asserted during the first field of each display update cycle by master timer 45, which in turn asserts the write enable lines 73 and 78 in the non-selected memory. Line 73 is asserted low during the first field of a pong memory 35 scanning cycle, and line 78 is asserted low during the first field of a ping memory 30 scanning cycle. Also, during a scanning cycle for one of the memory partitions, the read enable line 72 or 77 for the selected memory partition is asserted low for the entire scanning cycle, i.e. line 72 is asserted low during a ping memory 30 scanning cycle, and line 77 is asserted low during a pong memory 35 scanning cycle. Finally, chip enable lines 71 and 76 are asserted low whenever a read or write operation is to be performed on the memory partition, that is during the entire display update cycle when the corresponding memory partition is selected, and during autoset time when the corresponding memory partition is non-selected.

Figure 6:
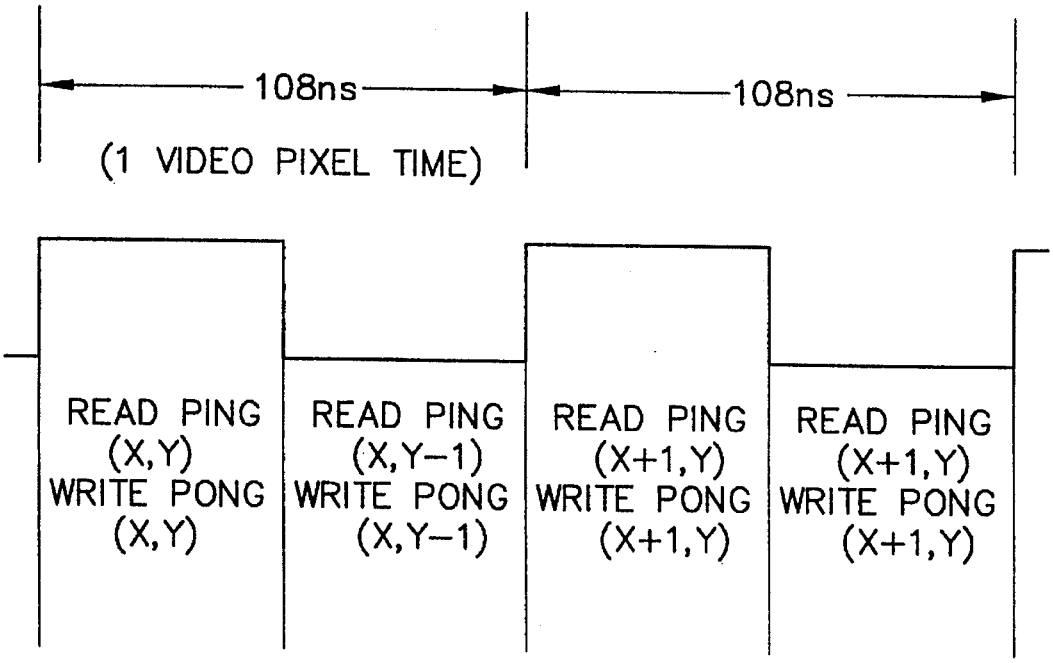
FIG. 6 is a timing diagram for a pixel scan cycle in a preferred embodiment consistent with the invention.

With the system configured to broadly operate as shown in FIG. 5, a data value should be provided to the video generator 10 in the range of once per 108 ns. The functional operation of the system in scanning and filling each memory cell is shown generally in FIG. 6, with pixel clock 120 having a video pixel time of 108 ns.

In each clock cycle, two memory cells from the selected memory partition are scanned, and two from the non-selected are filled. During the high state of clock 120, the memory cell at the current (x,y) in the selected memory partition is scanned, and the memory cell at the current (x,y) in the non-selected memory partition is filled. This function is performed by master timer 45 first providing the (x,y) address on lines 48, through multiplexers 50 and 55, to ping and pong memories 30 and 35 via address lines 52 and 57, respectively. Because ping and pong memories 30 and 35 have already been configured for reading and writing, respectively, ping memory 30 will provide its data value to interlaced raster enhancement means 41, and pong memory 35 will have the fill value from register 46 written therein, via lines 47 and 67 and buffer 66, upon receiving the current (x,y) address from master timer 45.

During the low state of clock 120, the memory cell in the adjacent row and current column (x,y−1) in the selected memory partition is scanned, and the memory cell in the adjacent row and current column (x,y−1) in the nonselected memory partition is filled. This function is also performed by master timer 45 providing the (x,y−1) address on lines 48, through multiplexers 50 and 55, to ping and pong memories 30 and 35 via address lines 52 and 57, respectively. The scanning and filling operations occur in the same manner as for the (x,y) address.

A memory partition is scanned in a video frame by the preferred embodiment consistent with typical interlaced video display systems. Scanning during a field of a frame proceeds from the top left corner of a video monitor (corresponding to the first memory cell in the first odd or even row in the memory partition, depending on whether the field is odd or even) and proceeds horizontally to the right. When the last column is reached, the display blanks, and proceeds to the beginning of the next odd or even row, depending on whether the field is an odd or even field. The scanning continues in this manner rightwards and downwards through the display until the last column in the last row, corresponding to the last memory cell in the partition, has been scanned.

At the end of a field, line 110 will be toggled to select the opposite field, the display will blank, and the scanning will continue at the top left corner of the display in the next field. One skilled in the art will recognize, however, that fields could also start in the middle of a row, or any other column in a row, for video display systems which use fields with having fractions of rows, such as the RS-170 standard.

Any number of fields may be included in a display update frame. The preferred embodiment discussed above repeats the first field after the second field, thereby scanning a total of three fields per each display update frame.

The preferred embodiment as described herein, operating at a display update rate of 20 Hz, is capable of filling an entire memory partition is approximately 16.7 ms, equal to one field scanning period. As discussed previously, a graphics generator operating on a similarly sized and configured system would require 32.8 ms. Therefore, the preferred embodiment as shown in FIG. 3 is approximately twice as fast as a comparable graphics generator, without slowing down, or adding components or complexity, to the system.

The present invention further provides a concurrent scan and fill method for use in a video display system of the ping-pong type having a memory including at least a first and a second memory partition. Methods consistent with the present invention provide for scanning the first memory partition and concurrently filling the second memory partition, such that a fill pattern is stored in every memory cell in the second memory partition during a time period in which a portion of memory cells in the first memory partition are scanned. By portion of memory cells, we mean a group of the memory cells in a memory partition.

Another method consistent with the present invention is capable of filling two or more memory cells in the second memory partition for each memory cell that is scanned in the first memory partition.

Figure 7:
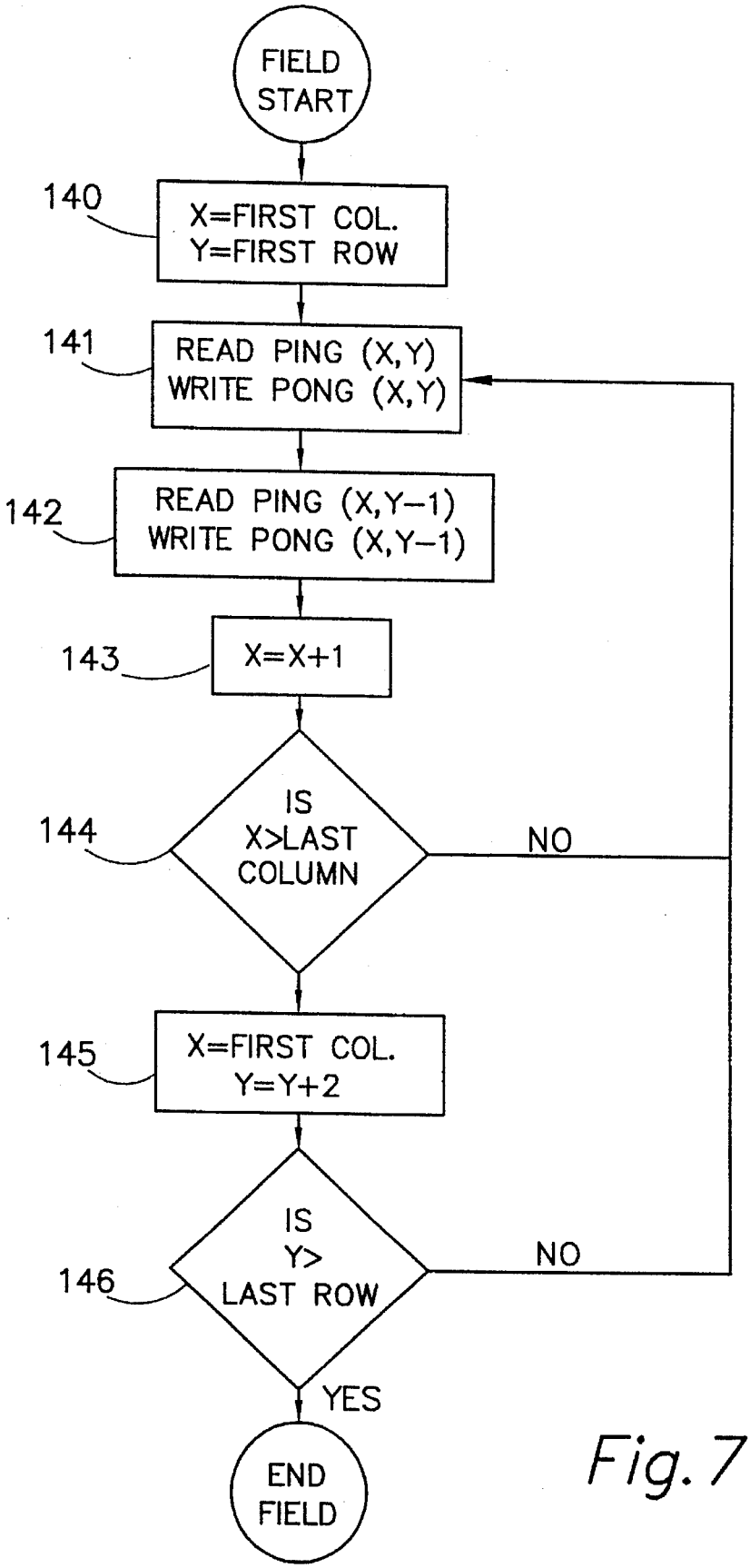
FIG. 7 is a flowchart for a preferred method consistent with the present invention.

One preferred method consistent with the present invention for concurrently filling and scanning a memory in a video display system of the ping-pong type is shown in FIG. 7. This method is for use with a memory comprising a first and a second memory partition (hereinafter a "ping" memory and a "pong" memory). Each memory partition includes a plurality of memory cells, each holding a data value and logically addressable in a two-dimensional array having a plurality of rows and columns. The memory cells are further divided into two subgroups, a first subgroup which are logically addressable in a first subgroup of rows, and a second subgroup which are logically addressable in a second subgroup of rows. Generally, the first and second subgroups of rows are odd-numbered and even-numbered rows, respectively, and discussion hereafter will assume this relationship.

Each the first and second memory partitions is selectable, such that one is the selected memory and the other is the non-selected memory. In general, the selection of either partition is toggled each display frame (e.g., by page selector line 91), such that when the first memory partition is selected the frame is designated the ping frame, and when the second is selected the frame is a pong frame. In addition each of the first and second subgroups of rows are selectable, such that one is the selected subgroup of rows and the second is the non-selected subgroup of rows. Selection of either subgroup of rows is typically toggled once a display field (e.g., by line 110 in master timer 45), such that when the first subgroup of rows is selected the field is designated an odd field, and when the second is selected the field is an even field.

A video display for use with the methods described herein is comprised of a plurality of pixels arranged in a plurality of columns and rows, each pixel having a corresponding memory cell in each memory partition.

The method is capable of concurrently filling a non-selected memory partition while scanning the memory cells in the selected subgroup of rows in the selected memory. For the purposes of illustration, FIG. 7 discloses a preferred method operating during the odd field of a ping frame. Therefore, the first memory partition and subgroup of rows are selected, and the second memory partition and subgroup of rows are non-selected. In addition, the preferred method is for use in conjunction with an interlaced raster enhancement system, where y and y−1 addresses are provided by a master timer.

The first step 140 of the method shown in FIG. 7 is to initialize current column and row pointers (x and y) to point to the first column and first group row in the memory partition. For the odd field, x=0 and y=1.

The second step 141 of the method includes reading, or scanning, the memory cell pointed to by (x,y) in the selected memory partition, and writing, or storing a fill pattern, in the memory cell pointed to by (x,y) in the non-selected memory partition.

The third step 142 of the method includes reading, or scanning, the memory cell pointed to by (x,y−1) in the selected memory partition, and writing, or storing a fill pattern, in the memory cell pointed to by (x,y−1) in the non-selected memory partition.

The fourth step 143 of the method includes incrementing the column pointer x to point to the next column in the current row. The fifth step 144 includes checking whether the last column has been addressed, such that all of the memory cells in the y (current) and y−1 rows of the selected memory partition have been scanned, and all of the memory cells in the y (current) and y−1 rows of the non-selected memory have been filled. If the last column has not been addressed, then the method returns to step 141, but if it has, it proceeds to step 145.

The sixth step 145 of the method includes resetting the current column pointer to the first column and incrementing the current row pointer to point to the next row in the selected subgroup of rows. The seventh step 146 includes checking if the last row has been addressed, such that all of the memory cells in the selected and non-selected memory partitions have been scanned and filled, respectively. If the last row has not been addressed, then the method returns to step 141, but if it has, then the field, and the method, are complete.

One of ordinary skill in the art will recognize that the above method is equally adaptable to work in many embodiments, both in hardware and software. The flowchart of FIG.

7 is merely illustrative of one particular embodiment of the present invention.

For instance, one skilled in the art would recognize that a method consistent with the present invention may include successively and repeatedly, for each of the first subgroup memory cells, the steps of storing a fill pattern in the first and a second subgroup memory cell in the nonselected memory partition, the second subgroup memory cell being logically addressable in a second subgroup row adjacent to the first subgroup row of the first subgroup memory cell, and scanning the first subgroup memory cell in the selected memory partition.

Methods consistent with the invention may be organized to store a fill pattern in two or more memory cells in one partition in the same time period as one memory cell in the other partition is scanned. This may be facilitated by generating multiple addresses, and thereby allowing multiple write operations, to one memory partition for each scan operation on a memory cell in another memory partition. Consequently, a fill or clear may be provided in less time than was previously possible using prior art graphics generators or the like on memory partitions having only a few physical storage devices, leaving ample time for graphics generation prior to the completion of the scanning of the other memory partition.

Some of the advantages of methods consistent with the invention are due to, in part, the ability of an interlaced raster enhancement video display system to provide both a y and a y−1 address. In such a system, a method consistent with the present invention may be included with little additional complexity or hardware. However, one skilled in the art will recognize that as interlaced raster enhancement is not the only method of providing one or more addresses during a scan cycle, the present invention is useful in a wide variety of application which do and do not incorporate interlaced raster enhancement. For instance, in the method shown in FIG. 7, step 142 could include only writing to the non-selected memory, without scanning the selected memory.

One skilled in the art will also recognize that the memory partitions need not be organized into odd and even-numbered rows, and that the adjacent row to the current row be addressed by the y−1 pointer. Further, methods consistent with the present invention need not be incorporated into interlaced systems, whereby the additional memory cells filled for each memory cell scanned could be addressed by an entirely different address. For instance, in a non-interlaced system, a fill could be completed in half of the frame by also providing an address which is a fixed distance from the first address, so that each half of a partition is filled concurrently.

In order for methods consistent with the invention to be implemented in continuous real-time display systems, additional steps may be included to provide repetitive progression through the method. For use with a system implementing two fields per display update frame, additional steps may be used of (1) selecting the non-selected subgroup of rows (e.g. toggling line 110), and scanning every memory cell in the selected subgroup of rows in the selected memory partition, and (2) selecting the non-selected memory partition (e.g. toggling page selector line 91), and returning to step 140 in FIG. 7. The first of these steps is merely performing the second field scan, where no fill is required. In fact, it is during this time that graphics generator 10 fills the non-selected memory partition with overlay information. The second of these steps constitutes beginning a new frame with the opposite memory partition.

For use with a system implementing three fields per display update frame, such as the preferred embodiment of FIGS. 3–7, an additional field, identical to step (1) above, may be inserted at the end of the second field scan in the two-field per display update frame system, prior to proceeding with the next display update (See in particular FIG. 5). In such an embodiment, three fields would be scanned per display update frame, with the third field being identical to the first. The non-selected memory partition would be filled in the first field, leaving the time period for two fields open for the graphics generator to provide overlay information to the memory.

It is important to note that while in a two-field update frame system a fill routine would typically always be performed during an odd field scan, in a three-field update frame, the fill routine would be performed on alternating odd and even field scans in each successive update frame. Therefore, methods consistent with the present invention are flexible enough to incorporate provisions for both first and second subgroups of rows into their filling procedures.

Although the present invention has been described with reference to preferred embodiments described above, workers skilled in the art will recognize that changes may be made in form and entail without departing from the spirit and scope of the invention. For instance, more than two memory cells could be filled in one memory partition for each memory cell scanned in the other. Embodiments with this feature could incorporate a master timer which provides additional addresses beyond (x,y) and (x,y−1 m).

Also, methods consistent with the invention would be useful in a system having more than two memory partitions, which would further increase the time available for a graphics generator to store overlay information in the memory. Further, embodiments are possible where the fill function could be performed independently from the scanning function, on different hardware, or at a different rate, for example.

In addition, rather than storing the same fill pattern in an entire memory partition, means could be provided in an embodiment where image values from a bit-mapped image could be provided to the scanning means as it proceeds through the concurrent scan and fill. In such an embodiment, the bit-mapped image could be automatically loaded into the non-selected memory partition prior to any overlay information being stored therein, which may be useful in displays requiring multiple information areas which may need to be distinguishable.

Finally, methods and apparatus consistent with the present invention could incorporate multiple writes to multiple physical storage devices in each memory partition. For instance, in memory 25, where each partition includes two physical storage devices, the two addresses provided by master timer 45 could be sent to each storage device as different addresses, providing, in essence, four addresses per memory cell scan, and completion of the fill in half of a field. Additional hardware and processing may be required for such an embodiment.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

The embodiments of the invention in which an exclusive property or right is claimed are defined as follows:

1. A method of concurrently filling and scanning a memory comprised of at least a first and a second memory partition, one of the first and second memory partitions initially being designated a selected memory partition, and the other initially being designated a non-selected memory partition, the first and second memory partitions being adapted for use in a video display of the ping-pong type which alternates between displaying video images stored in the first and second memory partitions, each memory partition having a plurality of memory cells logically addressable as a two-dimensional array having a plurality of columns and a plurality of rows, the plurality of rows being comprised of alternating first subgroup and second subgroup rows, each memory cell being logically addressable by a column and row from the plurality of columns and rows, respectively, the plurality of memory cells being comprised of first subgroup memory cells which are logically addressable in the first subgroup rows and second subgroup memory cells which are logically addressable in the second subgroup rows, the method comprising successively and repeatedly, for each of the first subgroup memory cells, the steps of:

storing a fill pattern in the first and a second subgroup memory cell in the non-selected memory partition, the second subgroup memory cell being logically addressable in a second subgroup row adjacent to the first subgroup row of the first subgroup memory cell; and scanning the first subgroup memory cell in the selected memory partition.

2. The method of claim 1, further comprising, successively and repeatedly, for each of the first subgroup memory cells, the step of scanning a second subgroup memory cell, the second subgroup memory cell being logically addressable in the second subgroup row adjacent to the first subgroup row of the first subgroup memory cell in the selected memory partition.

3. A method of concurrently filling and scanning a memory comprised of at least a first and a second memory partition, one of the first and second memory partitions initially being designated a selected memory partition, and the other initially being designated a non-selected memory partition, the first and second memory partitions being adapted for use in a video display system of the ping-pong type which alternates between displaying video images stored in the first and second memory partitions on a video display, each memory partition having a plurality of memory cells logically addressable as a two-dimensional array having a plurality of columns and a plurality of rows, the plurality of rows being comprised of alternating rows from a first subgroup of rows and rows from a second subgroup of rows, one of the first and second subgroups of rows initially being designated a selected subgroup of rows and the other initially being designated a non-selected subgroup of rows, each memory cell holding a data value and being logically addressable by a column and row from the plurality of columns and rows, respectively, the method comprising the steps of:

(a) selecting a current column from the plurality of columns and a current row from the selected subgroup of rows, such that the current column and row point to a first column and a first row, respectively;

(b) storing a fill pattern in the memory cell in the non-selected memory partition pointed to by the current column and row, and scanning the memory cell in the selected memory partition pointed to by the current column and row;

(c) storing the fill pattern in the memory cell in the non-selected memory partition pointed to by the current column and an adjacent row from the non-selected subgroup of rows;

(d) incrementing the current column to point to the next memory cell in the current row in each of the non-selected and selected memory partitions;

(e) repeating steps (b), (c) and (d) until the fill pattern is stored in every memory cell in the current and adjacent rows in the non-selected memory partition, and until every memory cell in the current row in the selected memory partition is scanned;

(f) resetting the current column and incrementing the current row to point to the memory cell in the first column and the next row in the selected subgroup of rows; and (g) repeating steps (b), (c), (d), (e) and (f) until the fill pattern is stored in every memory cell in the non-selected memory partition, and until every memory cell in the first subgroup of rows in the selected memory partition is scanned.

4. The method of claim 3, further comprising the step of:

(h) selecting the non-selected subgroup of rows such that the selected subgroup of rows becomes the non-selected subgroup of rows and the non-selected subgroup of rows becomes the selected subgroup of rows, and scanning every memory cell in the selected subgroup of rows in the selected memory partition.

5. The method of claim 4, further comprising the step of:

(i) selecting the non-selected memory partition such that the selected memory partition becomes the non-selected memory partition and the non-selected memory partition becomes the selected memory partition, selecting the non-selected subgroup of rows such that the selected subgroup of rows becomes the non-selected subgroup of rows and the non-selected subgroup of rows becomes the selected subgroup of rows, and returning to step (a).

6. The method of claim 4, further comprising the steps of:

(i) selecting the non-selected subgroup of rows such that the selected subgroup of rows becomes the non-selected subgroup of rows and the non-selected subgroup of rows becomes the selected subgroup of rows, and scanning every memory cell in the selected subgroup of rows in the selected memory partition; and (j) selecting the non-selected memory partition such that the selected memory partition becomes the non-selected memory partition and the non-selected memory partition becomes the selected memory partition, selecting the non-selected subgroup of rows such that the selected subgroup of rows becomes the non-selected subgroup of rows and the non-selected subgroup of rows becomes the selected subgroup of rows, and returning to step (a).

7. The method of claim 6, wherein the selected memory partition is initially the first memory partition, and wherein the selected subgroup of rows is initially the first subgroup of rows.

8. The method of claim 3, wherein step (c) further comprises scanning the memory cell in the selected memory partition pointed to by the current column and the adjacent row.

9. The method of claim 8, wherein the video display is comprised of a plurality of pixels arranged in the plurality of rows and in the plurality of columns, each pixel having a corresponding memory cell in both the first and second memory partitions.

10. The method of claim 9, wherein the method is implemented in an interlaced video display system having a display update rate of 20 Hz, in which the rows in the plurality of rows are consecutively numbered, and in which rows in the first subgroup of rows are odd-numbered rows and rows in the second subgroup of rows are even-numbered rows, and wherein the adjacent row from the non-selected subgroup of rows is numbered one less than the current row.

11. The method of claim 9, wherein the method is implemented in a video display system having interlaced raster enhancement and wherein the method further comprises, between step (c) of claim 8 and step (d) in claim 3 the step of:

(a) consecutively comparing, in order, the data values in the memory cell scanned in step (b) of claim 3, the memory cell in an adjacent column to the memory cell scanned in step (b) of claim 3, the memory cell scanned in step (c) of claim 8, and the memory cell in an adjacent column to the memory cell scanned in step (c) of claim 8, and outputting the first of the data values which is not equivalent to the fill pattern to a video generator means for display on a video display, or, if all of the data values are equivalent to the fill pattern, outputting the data value in the memory cell scanned in step (b) of claim 3 to the video generator means.

12. The method of claim 9, wherein the video display is comprised of 262,144 pixels arranged in 512 rows and 512 columns, and wherein each memory partition is comprised of 262,144 memory cells arranged in 512 rows and 512 columns.

13. The method of claim 12, wherein each memory cell is 8 bits wide, and wherein each memory partition is comprised of two 256K×4 RAM integrated circuit chips.

14. The method of claim 3, wherein the method automatically executes at the beginning of a major display cycle, and wherein the method is completed concurrently with the completion of a first minor display cycle in the major display cycle.

15. A method of filling a memory partition for use with a video display with a fill pattern, the memory partition having a plurality of memory cells logically addressable as a two-dimensional array having a plurality of columns and a plurality of rows, the plurality of rows being comprised of alternating first subgroup and second subgroup rows, each memory cell being logically addressable by a column and row from the plurality of columns and rows, respectively, the method comprising the steps of:

(a) selecting a current column from the plurality of columns and a current row from the first subgroup of rows, such that the current column and row point to a first column and a first row, respectively;

(b) storing the fill pattern in the memory cell in the memory partition pointed to by the current column and row;

(c) storing the fill pattern in the memory cell in the memory partition pointed to by the current column and an adjacent second subgroup row which is adjacent to the current row;

(d) incrementing the current column to point to the next memory cell in the current row in the memory partition;

(e) repeating steps (b), (c) and (d) until the fill pattern is stored in every memory cell in the current and adjacent second subgroup rows in the memory partition;

(f) resetting the current column and incrementing the current row to point to the memory cell in the first column and the next row in the first subgroup of rows; and (g) repeating steps (b), (c), (d), (e) and (f) until the fill pattern is stored in every memory cell in the memory partition.

16. The method of claim 15, wherein the memory partition is a non-selected memory partition, the non-selected memory partition being one of a first or second memory partition for use in a video display of the ping-pong type which alternates between displaying video images stored in the first and second memory partitions, and wherein the other of the first or second memory partition is a selected memory partition having a plurality of memory cells logically addressable as a two-dimensional array having a plurality of columns and a plurality of rows, the plurality of rows being comprised of alternating first subgroup and second subgroup rows, each memory cell being logically addressable by a column and row from the plurality of columns and rows, respectively.

17. The method of claim 16, wherein step (b) further comprises scanning the memory cell in the selected memory partition pointed to by the current column and row.

18. The method of claim 17, wherein step (c) further comprises scanning the memory cell in the selected memory partition pointed to by the current column and the adjacent second subgroup row.

19. The method of claim 18, further comprising:

(h) scanning every memory cell in every second subgroup row in the selected memory partition; and (i) selecting the non-selected memory partition such that the selected memory partition becomes the non-selected memory partition and the non-selected memory partition becomes the selected memory partition, and returning to step (a).

20. A method of concurrently scanning from, and storing video information in, a memory comprised of at least a first and a second memory partition, one of the first and second memory partitions initially being designated a selected memory partition, and the other initially being designated a non-selected memory partition, the first and second memory partitions being adapted for use in a video display of the ping-pong type which alternates between displaying video images stored in the first and second memory partitions, each memory partition having a plurality of memory cells logically addressable as a two-dimensional array having a plurality of columns and a plurality of rows, the plurality of rows being comprised of alternating rows from a first subgroup of rows and rows from a second subgroup of rows, one of the first and second subgroups of rows initially being designated a selected subgroup of rows and the other initially being designated a non-selected subgroup of rows, each memory cell being logically addressable by a column and row from the plurality of columns and rows, respectively, the video information to be stored in the memory being comprised of a plurality of bit-mapped images, each bit-mapped image having a plurality of image values logically addressable by a column and row from the plurality of columns and rows, respectively, the method comprising the steps of:

(a) selecting a current column from the plurality of columns and a current row from the selected subgroup of rows, such that the current column and row point to a first column and a first row, respectively;

(b) providing a first image value pointed to by the current column and row in a bit-mapped image from the plurality of bit-mapped images, storing the first image value in the memory cell in the non-selected memory partition pointed to by the current column and row, and scanning the memory cell in the selected memory partition pointed to by the current column and row;

(c) providing a second image value pointed to by the current column and an adjacent row from the non-selected subgroup of rows in the bit-mapped image, and storing the second image value in the memory cell in the non-selected memory partition pointed to by the current column and the adjacent row;

(d) incrementing the current column to point to the next memory cell in the current row in each of the non-selected and selected memory partitions;

(e) repeating steps (b), (c) and (d) until image values from the bit-mapped image are stored in every memory cell in the current and adjacent rows in the non-selected memory partition, and until every memory cell in the current row in the selected memory partition is scanned;

(f) resetting the current column and incrementing the current row to point to the memory cell in the first column and the next row in the selected subgroup of rows; and (g) repeating steps (b), (c), (d), (e) and (f) until image values from the bit-mapped image are stored in every memory cell in the non-selected memory partition, and until every memory cell in the first subgroup of rows in the selected memory partition is scanned.

21. The method of claim 20, wherein step (c) further comprises scanning the memory cell in the selected memory partition pointed to by the current column and the adjacent row.

22. The method of claim 20, further comprising the step of:

(h) selecting the non-selected subgroup of rows such that the selected subgroup of rows becomes the non-selected subgroup of rows and the non-selected subgroup of rows becomes the selected subgroup of rows, and scanning every memory cell in the selected subgroup of rows in the selected memory partition.

23. The method of claim 22, further comprising the step of:

(i) selecting the non-selected memory partition such that the selected memory partition becomes the non-selected memory partition and the non-selected memory partition becomes the selected memory partition, selecting the non-selected subgroup of rows such that the selected subgroup of rows becomes the non-selected subgroup of rows and the non-selected subgroup of rows becomes the selected subgroup of rows, and returning to step (a).

24. The method of claim 22, further comprising the steps of:

(i) selecting the non-selected subgroup of rows such that the selected subgroup of rows becomes the non-selected subgroup of rows and the non-selected subgroup of rows becomes the selected subgroup of rows, and scanning every memory cell in the selected subgroup of rows in the selected memory partition; and (j) selecting the non-selected memory partition such that the selected memory partition becomes the non-selected memory partition and the non-selected memory partition becomes the selected memory partition, selecting the non-selected subgroup of rows such that the selected subgroup of rows becomes the non-selected subgroup of rows and the non-selected subgroup of rows becomes the selected subgroup of rows, and returning to step (a).

25. The method of claim 24, wherein the selected memory partition is initially the first memory partition, and wherein the selected subgroup of rows is initially the first subgroup of rows.

26. A video display system of the ping-pong type comprising:

a memory comprised of at least first and second memory partitions, the first and second memory partitions are selectable such that when one of the first and second memory partitions is selected, the other of the first and second memory partitions is non-selected, each memory partition having a plurality of memory cells logically addressable as a two-dimensional array having a plurality of columns and a plurality of rows, the plurality of rows being comprised of alternating rows from a first subgroup of rows and rows from a second subgroup of rows, each memory cell holding a data value and being logically addressable by a column and row from the plurality of columns and rows, respectively;

graphics generator means for providing video information to the memory, the graphics generator means comprising means for storing the video information as data values in memory cells in the first and second memory partitions;

scanning means for continuously scanning the memory and for providing a stream of data values, the scanning means comprising means for alternating between selecting the first and second memory partitions such that in a first field of a display update frame, the scanning means scans the selected memory partition and provides data values from the memory cells in the first subgroup of rows of the selected memory partition, and in a second field of the frame, the scanning means scans the selected memory partition and provides data values from the memory cells in the second subgroup of rows of the selected memory partition, the scanning means further comprising filling means for storing a fill pattern in each memory cell in the non-selected memory partition concurrently with scanning the selected memory partition and providing data values from the memory cells in the first subgroup of rows in the selected memory partition in the first field of the frame; and video generator means for generating video signals from the stream of data values provided by the scanning means.

27. The apparatus of claim 26, wherein the scanning means comprises means for scanning every memory cell in the selected memory partition in each field of the frame.

28. The apparatus of claim 27, wherein the scanning means further comprises an interlaced raster enhancement means for selecting the data values to be provided in the stream of data values by the scanning means from adjacent memory cells located in the first and second subgroups of rows of the selected memory partition.

* * * * *